US006988474B2

(12) United States Patent
Itoafa

(10) Patent No.: US 6,988,474 B2
(45) Date of Patent: Jan. 24, 2006

(54) HYDRAULIC CAM FOLLOWER

(75) Inventor: Calin Petru Itoafa, Herzogenaurach (DE)

(73) Assignee: Ina-Schaeffler KG, (DE)

( * ) Notice: Subject to any disclaimer, the term of this patent is extended or adjusted under 35 U.S.C. 154(b) by 0 days.

(21) Appl. No.: 10/935,935

(22) Filed: Sep. 8, 2004

(65) Prior Publication Data

US 2005/0056246 A1 Mar. 17, 2005

(30) Foreign Application Priority Data

Sep. 16, 2003 (DE) ..... 103 42 642

(51) Int. Cl.
*F01L 1/18* (2006.01)

(52) U.S. Cl. ..... 123/90.44; 123/90.39; 123/90.16

(58) Field of Classification Search ..... 123/90.39, 123/90.44, 90.45, 90.48, 90.52, 90.6, 90.12, 123/90.13, 90.16, 90.27, 90.31, 90.2; 74/567, 74/569

See application file for complete search history.

(56) References Cited

U.S. PATENT DOCUMENTS 6,196,175 B1 * 3/2001 Church ..... 123/90.16
6,497,207 B2 * 12/2002 Spath et al. ..... 123/90.16

* cited by examiner

*Primary Examiner*—Thomas Denion
*Assistant Examiner*—Ching Chang
(74) *Attorney, Agent, or Firm*—Charles A. Muserlian

(57) ABSTRACT

The invention proposes a cam follower (1) comprising a hydraulic clearance compensation device (27) from whose reservoir (8) a controlled and throttled supply of hydraulic medium to lubricating points of the abutting tappet push rod and the associated rocker arm is realized with the help of an oil distributing disk (12) that extends in the reservoir (8). Projections (19) configured, for example, as bulging formations (21), are arranged on an underside (13) of a support (7) for the tappet push rod. In the presence of hydraulic medium pressure, the oil distributing disk (12) is pressed against the projections (19) and enables a purposed and throttled transfer of hydraulic medium between its upper side (18) and the underside (13) into an axial passage (11) of the support (7).

13 Claims, 3 Drawing Sheets

HYDRAULIC CAM FOLLOWER

FIELD OF THE INVENTION

The invention concerns a hydraulic cam follower for a valve train of an internal combustion engine, said cam follower being suitable for installation in driving relationship between at least one cam and a tappet push rod, said cam follower comprising a hollow cylindrical housing that is plugged together with an axially relatively displaceable pressure piston, one front end of the housing comprising a cam contacting element and an end face of the pressure piston oriented away from said front end comprising a support for the tappet push rod, the pressure piston comprising a reservoir for hydraulic medium, which reservoir serves to supply hydraulic medium to a high pressure chamber situated between a further end face of the pressure piston and said one front end of the housing, said reservoir being intersected by at least one passage for inlet of hydraulic medium, and the support comprising an axial passage for conveying hydraulic medium coming from the reservoir to the tappet push rod.

BACKGROUND OF THE INVENTION

Cam followers of the pre-cited type are well known in the technical field and are used, for example, in V-type engines with a central camshaft for transmitting the cam lift to corresponding tappet push rods. These cam followers comprise a hydraulic clearance compensation element that communicates with the oil supply gallery of the internal combustion engine. In recent times, such cam followers are also being increasingly designed for being connected to or disconnected from the cam lift.

A supply of hydraulic medium to the pressure piston that is axially displaceable in the housing is effected through a duct from the internal combustion engine extending radially through the housing into the reservoir. The reservoir thus serves to store the hydraulic medium for supply to the hydraulic clearance compensation device. On the upper side of this reservoir is arranged an axial passage for further conveyance of the hydraulic medium towards or through the tappet push rod. It is also possible, in this way, to lubricate other valve train components like the support of the tappet push rod or contact points on the rocker arm etc. If necessary, provision can also be made for the supply of switching oil to a switching mechanism in the rocker arm.

As disclosed, for instance, in FIG. 9 of U.S. 2003/0075129 A1, the supply pressure of the hydraulic medium in the reservoir acts without being throttled in the direction of the axial passage of the support for the push rod. Under certain circumstances, an excessive loss of hydraulic medium can occur in this arrangement during the firing of the internal combustion engine and this can lead to a deficient supply of hydraulic medium to the clearance compensation device. In other words, an unnecessarily high diversion of the hydraulic medium flow takes place in the direction of the tappet push rod.

In addition, it is noticed that the aforesaid prior art has the inherent danger of a "choking" of the axial passage due to impurities contained in the hydraulic medium or primary dirt particles in the internal combustion engine etc. Thus, the lubricating function through the axial passage would be obstructed and this could cause damage to the friction surfaces to be lubricated.

OBJECTS OF THE INVENTION

It is an object of the invention to propose a hydraulic cam follower of the pre-cited type in which the aforesaid drawbacks are eliminated with simple measures. More particularly, it is also an object of the invention to assure that the hydraulic medium flow is more exactly divided in the reservoir and can be routed in a controlled and throttled manner in the direction of the axial passage.

These and other objects and advantages of the invention will become obvious from the following detailed description.

SUMMARY OF THE INVENTION

The invention achieves the above objects by the fact that a) axially above the passage in the reservoir is arranged an oil distributing disk that is slightly displaceable in axial direction between an underside of the support and a stop of a bore of the reservoir;

b) an annular gap is arranged between the bore and an edge of the oil distributing disk;

c) on at least one of following elements: the underside of the support and at least an upper side of the oil distributing disk, are arranged projections that serve as spacers from an opposing one of said elements to permit a throttled transfer of hydraulic medium from the reservoir via the annular gap along the upper side of the oil distributing disk into the axial passage.

Alternatively, the invention likewise achieves the above objects by the fact that a) axially above the passage in the reservoir is arranged an oil distributing disk that is slightly displaceable in axial direction between an underside of the support and a stop of a bore of the reservoir;

b) an annular gap is arranged between the bore and an edge of the oil distributing disk;

c) in at least one of following elements: the underside of the support and an upper side of the oil distributing disk, are arranged channels as radial channels that communicate with the annular gap to permit a throttled transfer of hydraulic medium from the reservoir via the annular gap along the upper side of the oil distributing disk into the axial passage.

In this way, due to the positive arrangement of the oil distributing disk in the reservoir, a pin-point supply of the axial passage of the support with hydraulic medium can be realized. Through the height of the projections acting as spacers, or the depth of the channels, as the case may be, the hydraulic medium flow can be adjusted very exactly. At the same time, these measures also serve to prevent the oil distributing disk from sticking fast to the underside of the support, which sticking would block the hydraulic medium transfer. In this way, the lubricating points situated downstream of the axial passage can be positively supplied with a small quantity of hydraulic medium and the larger supply pressure is applied, as desired, to the hydraulic clearance compensation element.

A choking of the axial passage with dirt as mentioned above, can be avoided by an appropriate choice of its diameter. The oil distributing disk can be manufactured as a simple metal disk but it is also conceivable to make it out of a plastic. Advantageously, the projections in the form of bulges or ring segments on the disk are made in one piece with the disk.

The fact that according to a further proposition of the invention, the projections are arranged on both sides of the oil distributing disk simplifies the assembly of the cam follower because the disk thus does not need to be inserted with a defined orientation into the assembly line.

It is understood that other geometric shapes on the sides of the oil distributing disk and in the underside of the support will be obvious to the person skilled in the art for creating the aforesaid spacing and the transfer of hydraulic medium into the axial passage.

According to a further proposition of the invention, the radial channels in the underside of the support are made, for example, by stamping. However, it is also conceivable to use a machining method.

Manufacturing becomes particularly simple if the support that is firmly connected to the pressure piston is made as a separate component. This can then be connected by a known joining method to the rest of the pressure piston.

Further, the projections on the upper side of the oil distributing disk can be constituted by through-stampings or the like extending along the edge of this disk. Alternatively, it is also conceivable to generate the projections in the oil distributing disk, for example, by coining. If required, the projections may also be made separately and connected to the oil distributing disk after this has been manufactured.

A further proposition of the invention concerns the configuration of the oil distributing disk. To create the spacing from the underside of the support, this oil distributing disk may have a bent configuration. It is proposed to provide at least two bends extending parallel to each other. From a manufacturing point of view, this measure can likewise be implemented in a particularly economic manner.

A further advantageous development of the invention concerns the implementation of the measures proposed by the invention on a cam follower that can be disconnected from the cam lift. Suitable coupling elements could be constituted in this case, for example, by outwards displaceable slides. It is understood that the invention can also be used with cam followers that can be switched to different cam lifts and, if desired, also with other types of cam followers than the one discussed in the present context.

A particularly low-friction cam contact can be achieved if the cam-contacting element is a roller. Advantageously, this roller is arranged in the cam follower through a rolling bearing. A sliding contact may also be used, if desired.

The invention will now be described more closely with reference to the appended drawing.

DETAILED DESCRIPTION OF THE DRAWING

Figure 1:
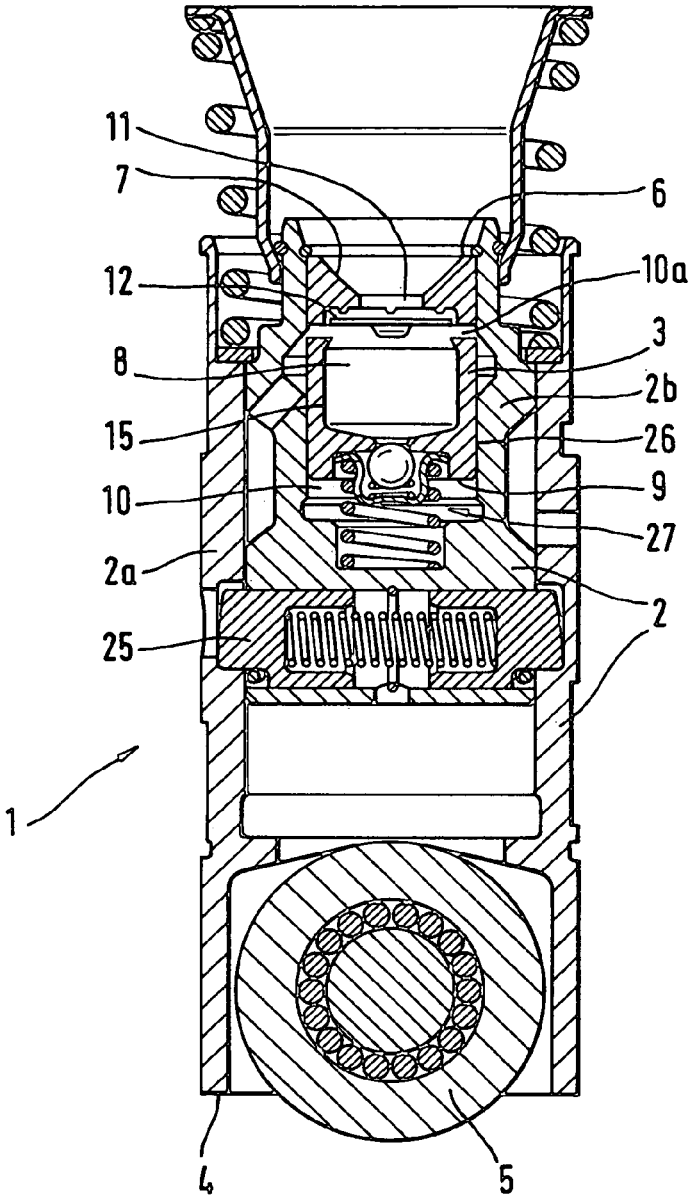
FIG. 1 shows a cam follower of the invention in a longitudinal section.

FIG. 1 discloses a hydraulic cam follower 1 of a type that is known per se in the technical field. Such a cam follower is also designated as a hydraulic roller tappet. In the present case, the cam follower 1 comprises a two-piece hollow cylindrical housing 2 in whose reception 26 an axially displaceable pressure piston 3 is installed. An outer part 2*a* of the housing 2 comprises a cam-contacting element 5 in the form of a roller in the region of one front end 4. An inner part 2*b* of the housing 2 can be optionally connected firmly by a coupling element 25, not requiring further specification here, to the outer part 2*a* for achieving a large cam lift.

In the present example of embodiment, an end face 6 of the pressure piston 3 directed away from the front end 4 has a separately configured support 7 for one end of a tappet push rod, not illustrated. A high pressure chamber 10 of a clearance compensation device 27 extends axially between a further end face 9 and a region of the inner part 2*b* of the housing 2 oriented toward the front end 4. Axially above the high pressure chamber 10, a reservoir 8 for hydraulic medium is enclosed by a bore 15 of the pressure piston 3. This reservoir 8 is supplied with hydraulic medium radially from the outside through a passage 10*a*, in the last analysis, from the hydraulic medium gallery of the internal combustion engine.

The support 7 can be made as a separate part and connected firmly to the pressure piston 3, but it is also possible to make this support 7 in one piece with the pressure piston 3. The support 7 comprises an axial passage 11 for hydraulic medium that is supplied from the reservoir 8. The reservoir 8 thus serves on the one hand to keep ready hydraulic medium for the clearance compensation device 27 situated therebelow. On the other hand, this reservoir 8 also serves to supply hydraulic medium to the lubricating points of the valve train situated downstream of the axial passage 11.

Figure 2:
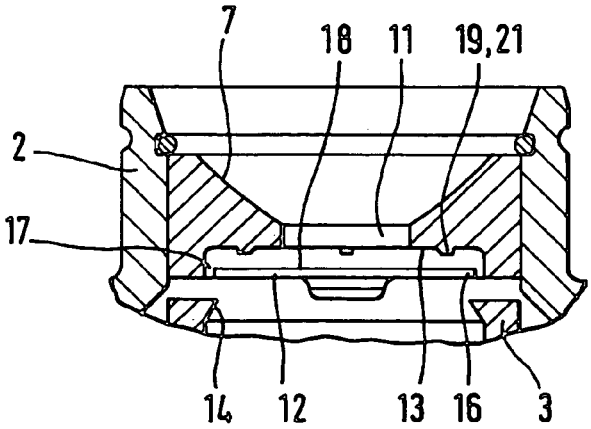
FIG. 2 is an enlarged detail of the cam follower in the region of the oil distributing disk.

As best seen in FIG. 2, an oil distributing disk 12 extends axially beneath an underside 13 of the support 7. This oil distributing disk 12 is slightly moveable axially between the underside 13 and a stop 14, configured here as an annular stop, that extends in the bore 15 of the pressure piston 3.

Figure 3:
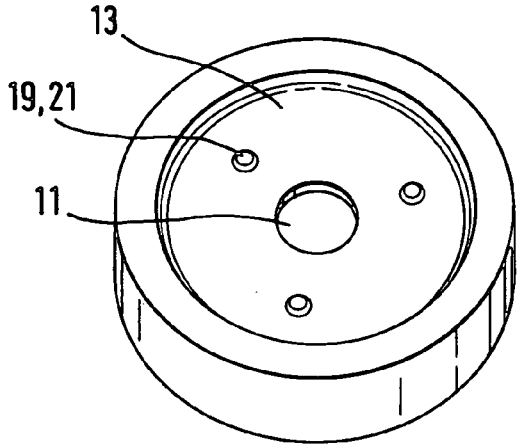
FIG. 3 is a bottom view of the support comprising bulging formations acting as spacers.

According to FIG. 2, in order to realize a purposed but throttled oil flow into the axial passage 11 in the presence of hydraulic medium pressure, the underside 13 comprises projections 19. As better shown in FIG. 3, these projections 19 can be configured, for instance, in the form of bulging formations 21. Further, an annular gap 17 for hydraulic medium extends between an edge 16 of the oil distributing disk 12 and the bore 15 of the pressure piston 3. In the presence of a sufficiently high hydraulic medium pressure in the reservoir 8, the oil distributing disk 12 is pressed axially upwards against the projections 19. In this way, the hydraulic medium can penetrate only in a controlled and throttled manner into the axial passage 11 through the annular gap 17 and the gap that subsists between the underside 13 and an upper side 18 of the oil distributing disk 12. A "sticking-fast" of the oil distributing disk 12 is likewise prevented by the projections 19 on the underside 13. As a result, a controlled and throttled supply of hydraulic medium to the lubricating points situated downstream of the axial passage 11 is realized.

Figure 4:
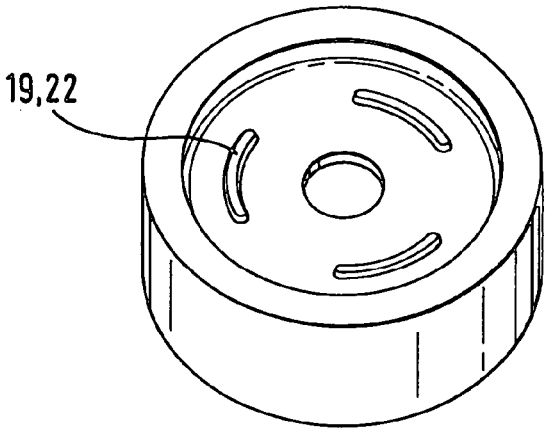
FIG. 4 shows the support comprising ring segments as spacers.

FIG. 4 discloses an alternative configuration of the projections 19, viz., in the form of ring segments 22, for instance.

Figure 5:
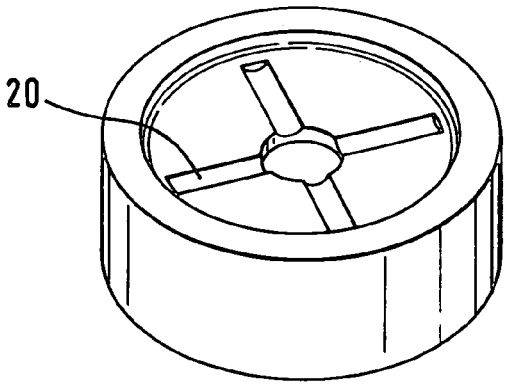
FIG. 5 shows the support comprising radial channels.

According to another proposition of the invention, a controlled and throttled oil flow can be achieved by arranging appropriately configured radial channels 20 in the underside 13 of the support 7. This can best be seen in FIG. 5.

Figure 6:
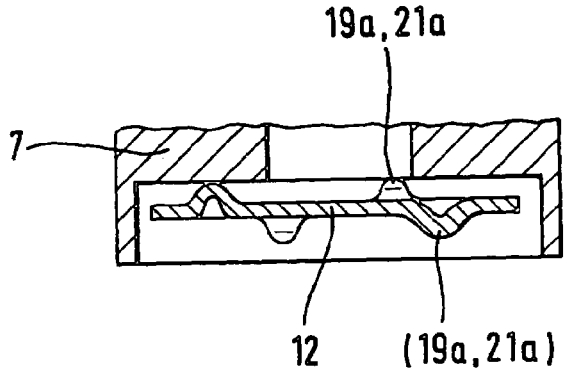
FIG. 6 is a schematic representation of the oil distributing disk comprising bulging formations on both sides.
Figure 7:
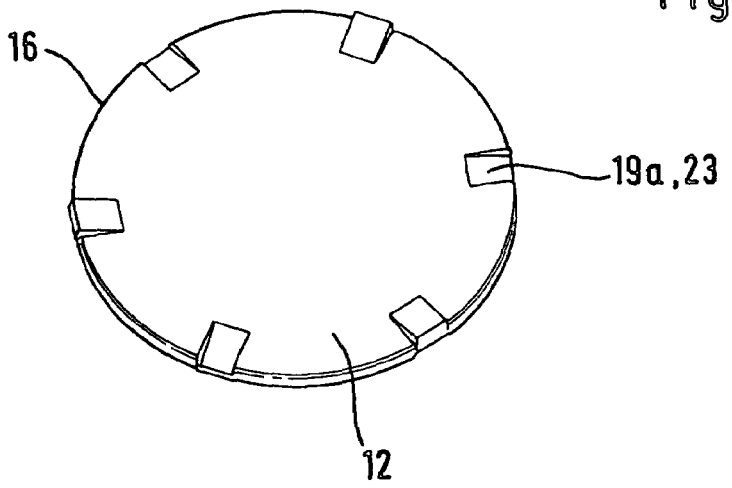
FIG. 7 shows the oil distributing disk comprising material displacements along its edge.
Figure 8:
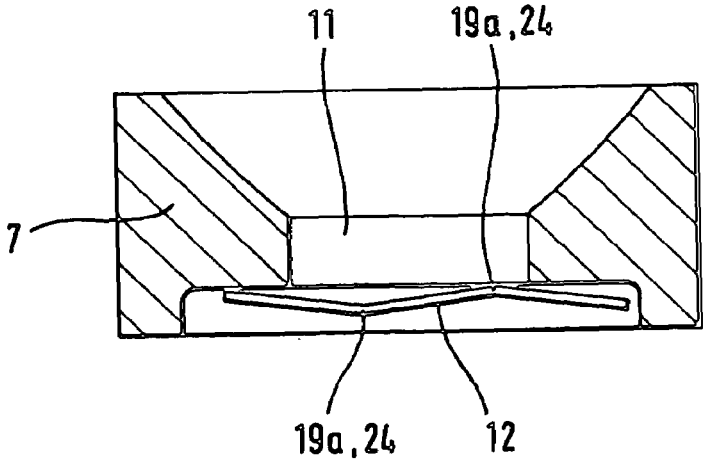
FIG. 8 is a representation of the oil distributing disk configured as a "bent disk".

As disclosed in FIGS. 6 to 8, the spacers in the form of projections 19*a* may be disposed on the oil distributing disk 12 itself. According to FIG. 6, the projections 19*a* are arranged on both sides of the oil distributing disk 12 and are configured, in this embodiment, in the form of bulging formations 21.

According to a further provision of the invention as shown in FIG. 7, the projections 19*a* may be constituted by circumferentially spaced material displacements 23 starting from the edge 16 of the oil distributing disk 12.

FIG. 8 finally shows a further variant for the creation of the projections 19*a*. In this case, the oil distributing disk 12 comprises at least two parallel bends 24 extending in opposite directions.

What is claimed is:

1. A hydraulic cam follower for a valve train of an internal combustion engine, said cam follower being suitable for installation in driving relationship between at least one cam and a tappet push rod, said cam follower comprising a hollow cylindrical housing that is plugged together with an axially relatively displaceable pressure piston, one front end of the housing comprising a cam contacting element and an end face of the pressure piston oriented away from said front end comprising a support for the tappet push rod, the pressure piston comprising a reservoir for hydraulic medium, which reservoir serves to supply hydraulic medium to a high pressure chamber situated between a further end face of the pressure piston and said one front end of the housing, said reservoir being intersected by at least one passage for inlet of hydraulic medium, and the support comprising an axial passage for conveying hydraulic medium coming from the reservoir to the tappet push rod, wherein a) axially above the passage in the reservoir is arranged an oil distributing disk that is slightly displaceable in axial direction between an underside of the support and a stop of a bore of the reservoir;

b) an annular gap is arranged between the bore and an edge of the oil distributing disk;

c) on at least one of following elements: the underside of the support and at least an upper side of the oil distributing disk, are arranged projections that serve as spacers from an opposing one of said elements to permit a throttled transfer of hydraulic medium from the reservoir via the annular gap along the upper side of the oil distributing disk into the axial passage.

2. A cam follower of claim 1, wherein the projections on the underside of the support and the upper side of the oil distributing disk are configured as one of bulging formations, ring segments and strip segments that are optionally made integrally on the underside of the support or the upper side of the oil distributing disk.

3. A cam follower of claim 1, wherein the projections are made at least on the upper side of the oil distributing disk as through-stampings or material displacements on an edge or edge-proximate region.

4. A cam follower of claim 1, wherein the projections are constituted by two roof-like bends that are situated opposite each other at a center point of the oil distributing disk and extend parallel to each while being oriented in opposite directions.

5. A cam follower of claim 1, wherein the cam follower is designed to be disconnected from cam lift, the housing of the cam follower comprising an outer and an inner part that are telescoped together, which outer part comprises the cam contacting element on one front end and can be optionally coupled by a coupling element to the inner part, the pressure piston being guided directly in a reception of the inner part.

6. A cam follower of claim 1, wherein the support of the pressure piston is made as a separate part.

7. A cam follower of claim 1, wherein the cam contacting element is a roller.

8. A cam follower of claim 1, wherein the projections of the oil distributing disk extend on both sides of the oil distributing disk.

9. A hydraulic cam follower for a valve train of an internal combustion engine, said cam follower being suitable for installation in driving relationship between at least one cam and a tappet push rod, said cam follower comprising a hollow cylindrical housing that is plugged together with an axially relatively displaceable pressure piston, one front end of the housing comprising a cam contacting element and an end face of the pressure piston oriented away from said front end comprising a support for the tappet push rod, the pressure piston comprising a reservoir for hydraulic medium, which reservoir serves to supply hydraulic medium to a high pressure chamber situated between a further end face of the pressure piston and said one front end of the housing, said reservoir being intersected by at least one passage for inlet of hydraulic medium, and the support comprising an axial passage for conveying hydraulic medium coming from the reservoir to the tappet push rod, wherein a) axially above the passage in the reservoir is arranged an oil distributing disk that is slightly displaceable in axial direction between an underside of the support and a stop of a bore of the reservoir;

b) an annular gap is arranged between the bore and an edge of the oil distributing disk;

c) in at least one of following elements: the underside of the support and an upper side of the oil distributing disk, are arranged channels as radial channels that communicate with the annular gap to permit a throttled transfer of hydraulic medium from the reservoir via the annular gap along the upper side of the oil distributing disk into the axial passage.

10. A cam follower of claim 9, wherein the radial channels are made without chip removal by stamping.

11. A cam follower of claim 9, wherein the cam follower is designed to be disconnected from cam lift, the housing of the cam follower comprising an outer and an inner part that are telescoped together, which outer part comprises the cam contacting element on one front end and can be optionally coupled by a coupling element to the inner part, the pressure piston being guided directly in a reception of the inner part.

12. A cam follower of claim 9, wherein the support of the pressure piston is made as a separate part.

13. A cam follower of claim 9, wherein the cam contacting element is a roller.

* * * * *